US005449034A

United States Patent [19]

Klein et al.

[11] Patent Number: 5,449,034

[45] Date of Patent: Sep. 12, 1995

[54] METHOD OF DYNAMICALLY CONTROLLING THE WITHDRAWAL SPEED DURING A HEALING CYCLE FOLLOWING STICKING IN A PROCESS FOR THE CONTINUOUS CASTING OF STEEL

[75] Inventors: André Klein, Homecourt, France; Manfred M. Wolf, Zürich, Switzerland

[73] Assignee: Techmetal Promotion, Maizeres-les-Metz, France

[21] Appl. No.: 129,193

[22] PCT Filed: Dec. 29, 1993

[86] PCT No.: PCT/FR92/00286

§ 371 Date: Oct. 8, 1993

§ 102(e) Date: Oct. 8, 1993

[87] PCT Pub. No.: WO92/18273

PCT Pub. Date: Oct. 29, 1992

[30] Foreign Application Priority Data

Apr. 10, 1991 [FR] France ..... 91 04356

[51] Int. Cl.[6] ..... B22D 11/20

[52] U.S. Cl. ..... 164/454; 164/484; 164/478

[58] Field of Search ..... 164/478, 416, 454, 484

[56] References Cited

U.S. PATENT DOCUMENTS 4,911,224 3/1990 Keugen et al. ..... 164/478
5,305,820 4/1994 Tsuru et al. ..... 164/478

FOREIGN PATENT DOCUMENTS 0111000 6/1984 European Pat. Off. .
3307176 9/1984 Germany .

OTHER PUBLICATIONS

S. J. Bercovici Light Metals, A. Publication of the Metallurgical Society of AIME 1985 pp. 1285–1299 S. J. Bercovici: 'Optimisation of 3C roll caster by automatic control'.

*Primary Examiner*—Kuang Y. Lin
*Attorney, Agent, or Firm*—Ostrolenk, Faber, Gerb & Soffen

[57] ABSTRACT

On detection of an occurrence of skin sticking in the mould, the withdrawal speed is subjected to a cyclic variation which comprises a ramp from the cruising speed to a reduced, decelerated speed, a healing plateau, and an acceleration ramp from the reduced speed to the cruising speed, measures are taken to determine the ferritic potential (PF) of the steel which is being cast, to determine the gradients (d, a) of one of the two ramps as a function of this ferritic potential, and to determine the length ($t_r$) of the healing plateau as a function of the difference between the liquidus and solidus temperatures of said steel.

13 Claims, 2 Drawing Sheets

METHOD OF DYNAMICALLY CONTROLLING THE WITHDRAWAL SPEED DURING A HEALING CYCLE FOLLOWING STICKING IN A PROCESS FOR THE CONTINUOUS CASTING OF STEEL

BACKGROUND OF THE INVENTION

The invention concerns a method of dynamically controlling the withdrawal speed in a process for the continuous casting of steel, this method being of the type according to which, on detection of an occurrence of skin sticking in the moulds, the withdrawal speed is subjected to a cyclic variation which comprises a deceleration ramp from the cruising speed to a reduced speed, a healing plateau, and an acceleration ramp from the reduced speed to the cruising speed. .

Occurrences of skin sticking in the moulds of a continuous casting machine are very dangerous, since they can lead to breakouts. Particularly through the system developed by SOLLAC, under the name SAPSOL, the provision of warning of these sticking events is known to be given by an alarm system based on the monitoring of the temperatures of the mould walls by thermocouples inserted at two levels within the thickness of the walls of the vertical mould, below the meniscus. Other alarm systems have also been proposed. In the beginning, after an alarm was detected, the casting operation was stopped for a period of time considered to be long enough for healing to take place. Later, it was proposed that the withdrawal speed should be regulated over a healing cycle such as the one defined above, which avoids bringing the machine to a dead stop. However, this cycle, and more particularly its reduced-speed period, is not without consequences as regards the quality of the product surface and the productivity of the machine.

In horizontal continuous-casting installations, the known art also includes breakout detection methods which utilize stress measurements (EP-A-111 000), and methods which teach that product withdrawal should be stopped only if a sudden fall in temperature in the mould is detected (DE-A-33 07 176).

The object of the invention is to replace the management of this cycle by dynamic control which is adjusted to suit the behaviour of the steel, and which shortens the reduced-speed period to the minimum waiting time required for healing the area where sticking has occurred.

The invention achieves its object by determining the ferritic potential of the steel which is being cast, and by determining at least the gradients of the deceleration and acceleration ramps as functions of this ferritic potential.

The invention is, in effect, based on the discovery—itself based both on scientific considerations and on practical experiments—according to which the ferritic potential, as defined later, can be considered as the decisive factor in the regulation of the withdrawal speed during the healing cycle.

It has also appeared advantageous to determine the length of the healing plateau as a function of the difference between the liquidus and solidus temperatures of the steel which is being cast.

It is advantageous if, in the event of sticking, the reduced speed is of the order of 0.2 to 1 m/minute, so as to allow healing of the area where sticking has occurred.

Other features and advantages of the invention will become evident on reading the detailed description which follows.

DESCRIPTION OF THE INVENTION

Figure 1:
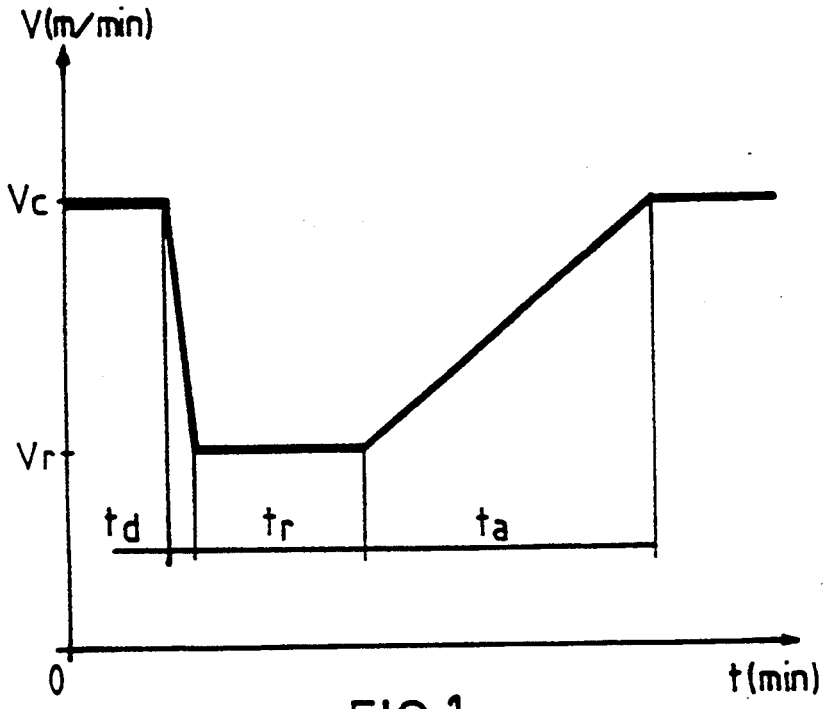
FIG. 1 is a diagram of the speeds during the healing cycle.

The diagram reproduced in FIG. 1 is a graphical representation of withdrawal speed V (in m/min) as a function of time t (in minutes) before, after and during the healing cycle. Before and after this cycle, the withdrawal speed is maintained at a cruising value $V_c$. In the event of an alarm being detected, the withdrawal speed is reduced to a value $V_r$ in the course of a reduction period $t_d$, such that the mean rate of decrease $d=(V_r-V_c)/t_d$, i.e. the deceleration ramp gradient. After a healing or waiting time $t_r$, the speed rises and returns to its value $V_c$ in the course of a period $t_a$, and such that the acceleration $a=(V_c-V_r)/t_a$.

According to the invention, it has been discovered that

- $t_d$ and d are strongly influenced by the tendency of the slab to swell between rolls, which itself depends on the high-temperature plastic deformation behaviour of the skin: a ferritic grade, with a low creep strength, calls for a long deceleration time $t_d$ (and a low value for d), whereas the-contrary holds good for an austenitic grade;
- $t_r$ is tied principally to the solidification range, i.e. to the difference between the liquidus and solidus temperatures, $T_L-T_S$ (in K): the outcome being that a high-alloy grade, with a high value for $T_L-T_S$, calls for a corresponding increase in $t_r$, and vice versa;
- $t_a$ and a require some adjustment in response to the tendency towards sticking, which is strong for wholly ferritic grades or wholly austenitic grades, but is weaker if a mixed austenitic/ferritic structure exists over the range of temperatures experienced by the skin.

All these considerations are broadly dependent on micro-segregation effects within the matrix, and ultimately depend on the ferritic or austenitic character of the grade of steel which is being cast, insofar as studies have shown that the presence of ferrite during the solidification phase has a very favourable influence as regards minimizing microsegregation. In view of the progressive variation of the ratio of the solid fractions of ferrite and austenite as a function of carbon content in the case of plain carbon or low-alloy steels, it appears possible to define a "ferritic potential" (PF) which expresses the fraction of ferrite formed during solidification. Thus:

$$PF=2.5\ (0.5-\%C_p)$$

where $\%C_p$ represents a carbon equivalent in the peritectic reaction, i.e. a carbon content corrected to take account of the influence of the other alloying elements.

In practice, use is made of the formula:

$$\%C_p=\%C+0.02\%\ Mn+0.04\%\ Ni-0.1\%\ Si-0.04\%\ Cr-0.1\%\ Mo$$

A value of 1, or higher, for the ferritic potential means that a wholly ferritic structure will be formed on solidification. Conversely, negative ferritic potential values indicate that wholly austenitic structures will be formed.

For stainless steels, the following formula is to be used for calculating ferritic potentials:

$$PF=5.26\ (0\ 74-[\%Ni'/\%Cr'])$$

where $$\%Ni'=\%Ni+0.31\%\ Mn+22\%\ C+14.2\%\ N+\%Cu$$

$$\%Cr'=\%Cr+1.5\%\ Si+1.4\%\ Mo+3\%\ Ti+2\%\ Nb$$

On the basis of a classification of steels constructed from their ferritic potentials as defined above, it appeared possible, starting essentially from data deriving from experience, to determine the optimum accelerations a and decelerations d for a healing cycle after an alarm. These optimum acceleration and deceleration values are displayed by the two lower curves in FIG. 2.

Figure 2:
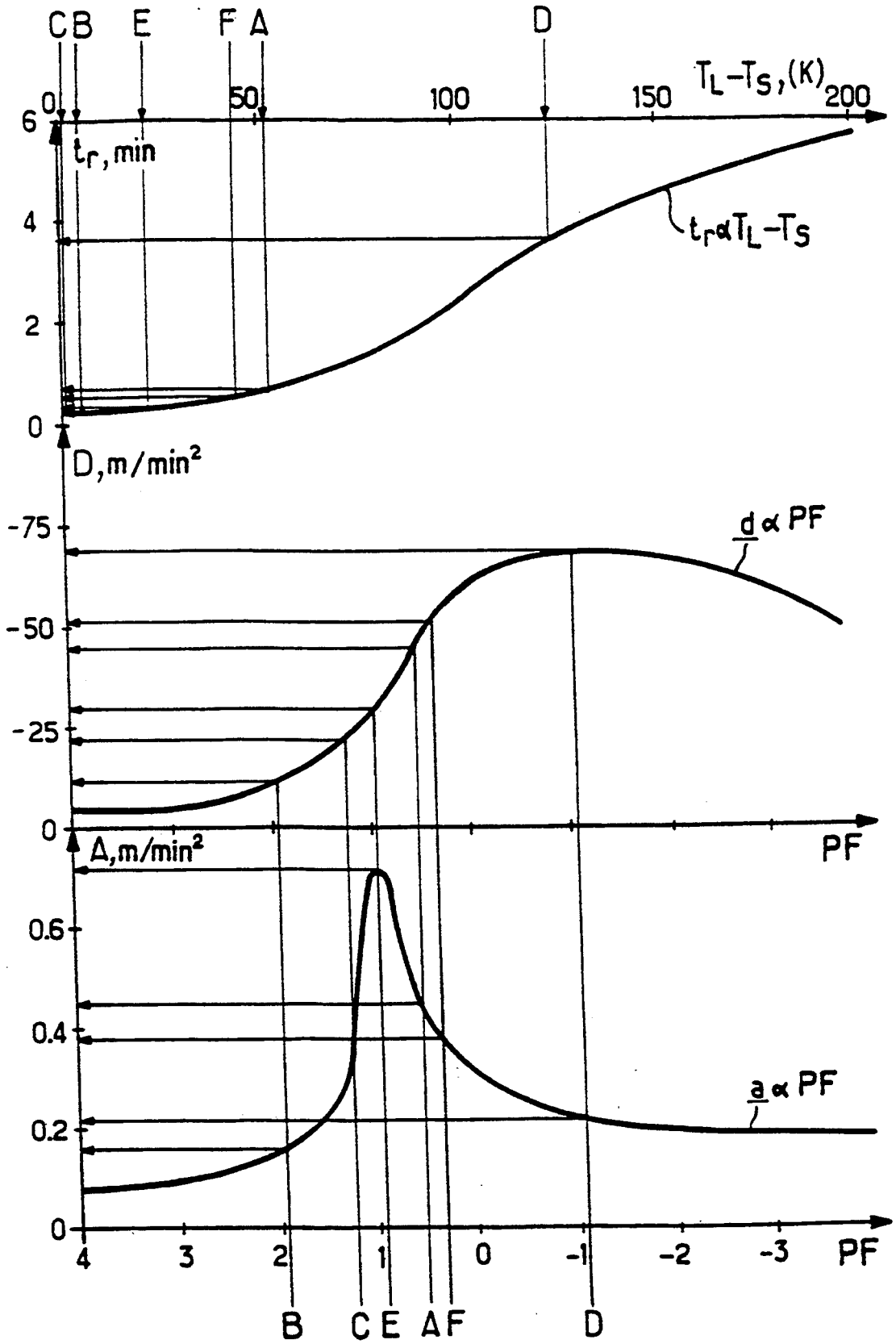
FIG. 2 comprises three diagrams, displayed one above another: from top to bottom, a graph of healing time (in minutes) as a function of solidification temperature range (in degrees), a graph of deceleration ramp gradient (in m/min$^2$) as a function of ferritic potential, and a graph of acceleration ramp gradient (in m/min$^2$) as a function of ferritic potential.

Thus, the curve at the bottom of FIG. 2 shows that the acceleration a, in $m/min^2$ expressed as a function of ferritic potential, increases from a value slightly below 0.1 $m/min^2$ for highly positive potentials, reaches a maximum of approximately 0.7 $m/min^2$ for a potential close to 1, and thence decreases to a value slightly below 0.2 $m/min^2$ for negative potentials.

A polynomial approximation for values of A as a function of PF gives the following expression:

$$a = f(PF) = a_0 + \sum_i a_1(PF)^1$$

with:

for $PF > 1$ $a_0 = 5.9$
$a_1 = -10.635$
$a_2 = 7.82$
$a_3 = -2.8459$
$a_4 = 0.5091$
$a_5 = -0.0357$ for $PF < 1$ $a_0 = 0.3116$
$a_1 = 0.2075$
$a_2 = 0.15$
$a_3 = 0.0471$
$a_4 = 0.0051$ The preferred acceleration times $t_a$ fall within the range 60 to 600 s.

In actual fact, it is advantageous to adjust the acceleration times $t_a$ (which result according to theory from the calculation $(V_c-V_r)/a$) in order to take account of other alloying elements as well, namely of those which promote sticking by influencing the viscosity of the slag in the mould. The following multiplication factors are to be used (corresponding to similar division factors for a):

| Element, content in % equal to or greater than | 0.05 | 0.1 | 0.5 |
|---|---|---|---|
| S | 1 | 2 | 3 |
| Al | 1 | 2 | 3 |
| Ti | 1.5 | 3 | 6 |
| Zr and/or REM | 2 | 4 | 10 |

As regards the deceleration, there again a polynomial approximation is possible:

$$d = f(PF) = a_0 + \sum_i a_1(PF)^1$$

with:
$a_0 = -57.15$
$a_1 = 21$
$a_2 = 7.68$
$a_3 = -1.83$
$a_4 = 0.822$
$a_5 = 0.0531$
$a_6 = 0.0289$ The preferred deceleration times $t_d$ are of the order of 0.5 to 30 s.

As regards the waiting time during the healing plateau, this time is tied, as has been stated, to the solidification range $T_L$-$T_S$, where $T_L$ and $T_S$ are the liquidus and solidus temperatures. It is advisable to take the true solidus temperatures for the given grade of steel into consideration, i.e. temperatures which have been adjusted relative to the theoretical solidus temperatures at equilibrium, so as to allow for the effects of sparingly soluble elements which cause some depression of the solidus, examples being phosphorus and sulphur.

In practice, the liquidus temperature $T_L$ is calculated as follows:

$$\text{for } PF>0:\ T_L=1538-90(\%C)-[\%X]$$

$$\text{for } PF<0:\ T_L=1528-60(\%C)-[\%X]$$

and the solidus temperature $T_S$, likewise $$\text{for } PF>1:\ T_S=1538-450(\%C)-[\%X]$$

$$\text{for } PF<1:\ T_S=1528-180(\%C)-[\%X]$$

where the coefficient X of the elements and alloys represents, respectively: 10Si, 5Mn, 2Cr, 3Ni, 3Mo, 3Cu, 8Nb, 14Ti, 3Al, 2V, 60B, 1W, 1Co, 34P, 40S, 14As, 10Sn, 36Se.

The uppermost diagram of FIG. 2 shows that the waiting time $t_r$ is an increasing function of the solidification range, in that, from values in the region of 15 s, it increases to values in the region of 6 minutes, the preferred times being of the order of 30 to 300 s.

A polynomial approximation for $t_r$ is as follows:

$$t_r = f(T_L - T_S) = a_0 + \sum_i a_1(T_L - T_S)^1$$

with:
$a_0 = 0.351$
$a_1 = -0.0194$
$a_2 = 0.000572$

-continued $$a_3 = -0.1715.10^{-5}$$

It is advantageous if the complete set of these curves are programmed into a computer or microprocessor which automatically manages the dynamic control of the healing cycle in liaison with the alarm system which gives warning of sticking. It is obvious that the d and a values indicated are mean values, and that they can be adjusted by roughly 20% in either sense, especially in order to implement non-linear speed changes.

By way of example, the values determined for six alloys, A, B, C, D, E, F, in a typical case involving the continuous casting of 250 mm×1800 mm slabs, are presented in FIG. 2 and in Table I which follows.

TABLE I

| Steel grade | A | B | C | D | E | F |
|---|---|---|---|---|---|---|
| | | | Analysis in % | | | |
| C | 0.05 | 0.02 | 0.005 | 1.0 | 0.12 | 0.35 |
| Si | 0.5 | 3.0 | | | | 0.20 |
| Mn | 1.5 | | | | 0.30 | 0.50 |
| Cr | 18.0 | | | 1.5 | | |
| Ni | 10.5 | | | | | |
| Ti | | | 0.05 | | | |
| Al | | | | | 0.03 | |
| | | | Characteristic values | | | |
| PF | 0.53 | 1.95 | 1.24 | −1.06 | 0.94 | 0.34 |
| $T_L$ (°C.) | 1460 | 1506 | 1537 | 1465 | 1526 | 1502 |
| $T_S$ (°C.) | 1408 | 1499 | 1535 | 1344 | 1504 | 1458 |
| $T_L - T_S$ (K) | 52 | 7 | 2 | 121 | 22 | 44 |
| | | | Dynamic control criteria*) | | | |
| d (m/min$^2$) | −44 | −12 | −20 | −68 | −30 | −52 |
| $t_d$ (s) | 1.4 | 5.0 | 3.0 | 0.9 | 2.0 | 1.2 |
| $t_r$ (min) | 0.7 | 0.3 | 0.3 | 3.6 | 0.3 | 0.5 |
| a (m/min$^2$) | 0.45 | 0.16 | 0.38 | 0.22 | 0.72 | 0.38 |
| $t_a$ (min) | 2.2 | 6.2 | 2.6*** | 4.5 | 1.4 | 2.6 |
| $t_a + t_r$ (min**) | 2.9 | 6.5 | 4.2 | 8.1 | 1.7 | 3.1 |

*)$V_c$ = 1.5 m/min; $V_r$ = 0.5 m/min
**)total time at reduced speed (healing period)
***)correction of $t_a$ for Ti: 2.6 × 1.5 = 3.9 min The advantage of the invention will be illustrated more effectively by the examples which follow, comprising, on the one hand, the conventional control and the dynamic control according to the invention, applied to one and the same grade of steel Y (0.06% C, 0.30% Mn, 0.015% P, 0.010% S, 0.040% Al; PF=1,085; $T_L - T_S = 1531 - 1508 = 23$ K) and, on the other hand, the dynamic control applied to steels of three different grades, B, D and Y.

Figure 3:
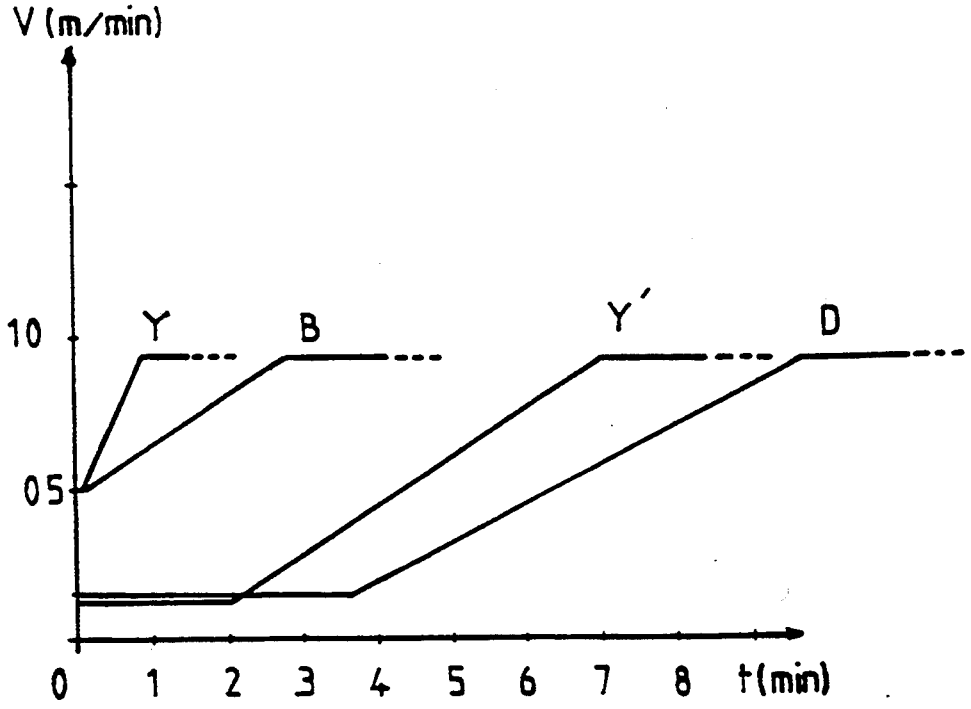
FIG. 3 is a diagram similar to the one displayed in FIG. 1, showing the healing cycles, according to the invention, for three grades of steel, Y, B, D, and the healing cycle for steel of grade Y', analogous to X, according to a conventional method.

Typical cycles for healing areas affected by sticking have been represented in one and the same Figure (FIG. 3), namely the cycle Y according to the invention and the cycle Y' according to a conventional method, applied to a low carbon steel (grade X), and in addition the cycle according to the invention applied to a high silicon steel for magnetic sheet (grade B) and to the high carbon Type 100 C 6 steel (grade D). The various cycle parameters are listed in Table II which follows.

It is evident that when a conventional method is applied, the cycle Y' calls for a total $t_a + t_r$ of 7 minutes, in addition to which there is a deceleration time of 0.9 s. The application of this conventional method results in a loss of productivity, as well as a deterioration in the surface quality.

Moreover, a similar, conventional cycle is traditionally applied to steels of all grades, since there is a lack of knowledge as to how to distinguish their different behavioural characteristics as regards the healing of areas where sticking has occurred.

On the contrary, when the invention is applied, it is evident that the healing cycle $t_a + t_r$ can be shortened to only approximately 1 minute, which corresponds to a productivity gain of nearly 90%, while the quality of the product surface is affected only over an area that is very short.

A similar gain is observed for steel B.

On the other hand, the grade D calls for a very much longer cycle, and the conventional method is insufficiently reliable to ensure effective healing of areas where sticking has occurred.

These examples clearly reveal the point at which the invention enables gains to be made in both reliability and productivity at one and the same time.

As has been stated, it is advantageous, for the majority of practical cases, to select the reduced speed $V_r$ from within the range 0.2 to 1 m/min. Nevertheless, its determination should preferably obey the following criteria: the reduced speed in the healing cycle is substantially equal to the larger of two values: one obtained by taking 70% of the cruising speed, in meters per minute and the other by considering the ratio of the useful length of the mould (in meters) to the length $t_r$ of the healing plateau in minutes. In other words, a speed $V_r$ substantially equal to 70% of $V_c$ is selected if this is compatible with the possibility of bringing about healing within the useful mould length L, which extends between the second level of the mould and the mould exit. For example, a mould with a total height of 0.90 m and the second-level thermocouples located at 0.30 m has a useful length of 0.6 m.

For the grade Y steel, FIG. 2 gives a time $t_r$ of 0.23 of a minute, and the speed corresponding to 70% of $V_c$ gives a theoretical speed $V_r$ of 1 m/min. Furthermore, it is possible to calculate a maximum useful time, $L/V_r = 0.6/1 = 0.6$ of a minute, which, being greater than 0.23, shows that the theoretical value for $V_r$ is appropriate.

On the other hand, for the grade D steel, the value of $t_r$, 3.65 minutes, exceeds the maximum useful time obtained with a speed $V_r$ of i m/min. The permissible speed $V_r$ is only $V_r = L/t_r = 0.6/3.6 = 0.15$ m/min, as employed in FIG. 3.

TABLE II

| Steel grade | Y | B | D | Y' |
|---|---|---|---|---|
| $V_o$, m/min | 1.4 | 1.4 | 1.4 | 1.4 |
| d, m/min$^2$ | −26 | −12 | −68 | −1.3 |
| $t_d$, min (s) | 0.015 (0.9) | 0.033 (2.0) | 0.02 (1.2) | (0.9) |
| $V_r$, m/min | 1.0 | 1.0 | 0.15 | 0.1 |
| $t_r$, min | 0.23 | 0.3 | 3.6 | 2.0 |
| A, m/min$^2$ | 0.58 | 0.16 | 0.22 | 0.26 |
| $t_a$, min | 0.7 | 2.5 | 6.1 | 5.0 |
| $t_r + t_a$, min | 0.93 | 2.8 | 9.7 | 7.0 |

We claim:

1. Method of dynamically controlling the withdrawal speed in a process for the continuous casting of steel comprising detecting the occurrence of skin sticking in the mould, on detection of an occurrence of skin sticking in the mould, subjecting the withdrawal speed to a cyclic variation which comprises a deceleration ramp from the cruising speed to a reduced, decelerated speed, a healing plateau, and an acceleration ramp from the reduced speed to the cruising speed, characterized in establishing at least the gradient of one of the two ramps as a function of the ferritic potential of the steel which is being cast.

2. Method according to claim 1, further characterized in the step of determining the ferritic potential of the steel which is being cast.

3. Method according to claim 2, characterized in establishing the length ($t_r$) of the healing plateau is established as a function of the difference between the liquidus and solidus temperatures of the steel which is being cast.

4. Method according to claim 2, characterized (PF) in selecting the value for the ferritic potential of low alloy steel to conform to the formula:

$$PF=2.5(0.5-\%Cp)$$

where $\%C_p$ is the carbon equivalent in the peritectic reaction, calculated in accordance with the formula:

$$\%C_p=\%C+0.02\%\ Mn+0.04\%\ Ni-0.1\%\ Si-0.04\%\ Cr-0.1\%\ Mo$$

and in that the value selected for the ferritic potential of stainless steel conform to the formula:

$$PF=5.26(0.74-[\%Ni'/\%Cr'])$$

where $$\%Ni'=\%Ni+0.31\%\ Mn+22\%\ C+14.2\%\ N+\%Cu$$

$$\%Cr'=\%Cr+1.5\%\ Si+1.4\%\ Mo+3\%\ Ti+2\%\ Nb$$

5. Method according to claim 2, characterized in that the length of ($t_r$) of the healing plateau is the ordinate value, to a degree of approximation, of the curves displayed in FIG. 2 at the abscissa point corresponding to the $T_L$-$T_S$ of the steel which is being cast, and the gradients of the deceleration and acceleration ramps are the ordinate values, to a degree of approximation, of the curves displayed in FIG. 2 at the abscissa point corresponding to the PF of the steel which is being cast.

6. Method according to claim 2, characterized in that the deceleration time($t_d$) is of the order of 0.5 to 30 s, the waiting time ($t_r$) at reduced speed is of the order of 30 to 300 s, and the acceleration time ($t_a$) is of the order of 60 to 600 s.

7. Method according to claim 2, characterized in controlling the withdrawal speed by means of a computer embodying a program for establishing the ramp speed gradient by a ferritic potential calculation according to the steel which is being cast.

8. (Amended) Method according to claim 2, characterized in that the reduced speed in the healing cycle in meters per minute is substantially equal to the larger of two values: one being 70% of the cruising speed, and the other being the useful length of the mould divided by the length $t_r$ of the healing plateau.

9. Method according to claim 3, characterized in selecting the value for the ferritic potential (PF) of low alloy steel to conform to the formula:

$$PF=2.5(0.5-\%C_p)$$

where $\%C_p$ is the carbon equivalent in the peritectic reaction, calculated in accordance with the formula:

$$\%C_p=\%C+0.02\%\ Mn+0.04\%\ Ni-0.1\%\ Si-0.04\%\ Cr-0.1\%\ Mo$$

and in that the value selected for the ferritic potential of stainless steel conform to the formula:

$$PF=5.26(0.74-[\%Ni'/\%Cr'])$$

where $$\%Ni=\%Ni+0.31\%\ Mn+22\%\ C+14.2\%\ N+\%Cu$$

$$\%Cr'=\%Cr+1.5\%\ Si+1.4\%\ Mo+3\%\ Ti+2\%\ Nb.$$

10. Method according to claim 9, characterized in that the length of ($t_r$) of the healing plateau is the ordinate value, to a degree of approximation, of the curves displayed in FIG. 2 at the abscissa point corresponding to the $T_L$-$T_s$ of the steel which is being cast and the gradients of the deceleration and acceleration ramps are the ordinate values, to a degree of approximation, of the curves displayed in FIG. 2 at the abscissa point corresponding to the PF of the steel which is being cast.

11. Method according to claim 10, characterized in that the deceleration time ($t_d$) is of the order of 0.5 to 30 s, the waiting time ($t_r$) at reduced speed is of the order of 30 to 300 s, and the acceleration time ($t_a$) is of the order of 60 to 600 s.

12. Method according to claim 11, characterized in controlling the withdrawal speed by means of a computer embodying a programme for establishing the ramp speed gradient by a ferritic potential calculation according to the steel which is being cast.

13. Method according to claim 12, characterized in that the reduced speed in the healing cycle in meters per minute is substantially equal to the larger of two values: one being 70% of the cruising speed, and the other being the useful length of the mould divided by the length $t_r$ of the healing plateau.

* * * * *